United States Patent [19]

Eglinton

[11] 4,245,796

[45] Jan. 20, 1981

[54] SYSTEM FOR HANDLING FLEXIBLE SHEET ROLLS

[75] Inventor: Robert B. Eglinton, Huntington Beach, Calif.

[73] Assignee: Chromalloy American Corporation, St. Louis, Mo.

[21] Appl. No.: 48,981

[22] Filed: Jun. 15, 1979

[51] Int. Cl.[3] ..... B65H 17/12

[52] U.S. Cl. ..... 242/66

[58] Field of Search ..... 242/66, DIG. 3, 75.2

[56] References Cited

U.S. PATENT DOCUMENTS

| | | | |
|---|---|---|---|
| 1,248,542 | 12/1917 | Pope . | |
| 1,872,018 | 8/1932 | Street . | |
| 2,750,127 | 6/1956 | Birr | 242/66 |
| 2,961,182 | 11/1960 | Beerli | 242/66 |
| 3,098,619 | 7/1963 | Washburn | 242/66 |
| 3,167,268 | 1/1965 | Birch et al. | 242/66 X |
| 3,250,484 | 5/1966 | Fair | 242/66 |
| 3,537,662 | 11/1970 | Keesling et al. | 242/56 R |
| 3,592,403 | 7/1971 | Schmidt | 242/56 R |
| 3,841,578 | 10/1974 | Dorfel | 242/66 |
| 3,850,381 | 11/1974 | Moore | 242/66 |
| 3,883,088 | 5/1975 | Cannon et al. | 242/75.2 |
| 3,931,940 | 1/1976 | Raighn et al. | 242/66 X |
| 4,002,308 | 1/1977 | Feighery | 242/66 |
| 4,102,512 | 7/1978 | Lewallyn | 242/66 |

*Primary Examiner*—John M. Jillions

*Attorney, Agent, or Firm*—William W. Haefliger

[57] ABSTRACT

Apparatus for rolling a sheet comprises (a) structure to receive the advancing sheet and to roll same, (b) that structure including supports over which the sheet travels, and auxiliary mechanism including first and second swingable arms and hold-down and dump rollers carried by the respective first and second arms to be movable between primary positions in which the hold-down and dump rollers are relatively collapsed toward one another for initiating sheet coiling, and a series of extending positions, in which roll-up of the sheet is guided toward completion into a built-up roll and the hold-down and dump rollers are increasingly spaced apart.

18 Claims, 11 Drawing Figures

5
5
6
6
3
3
4
4
123
126
116
119
117
122
124
30
113
114
115
112
118
85
110
120
81
163
88
87
83
162
109
78
33
79
78a'
79b'
108
78b'
140
79a'
32
86
190
56
80
82
30
110
110a
106
84
102
99
58
114a
101
98a
100
128
30
107
90
91
97
104
93
95
94
92
98
105

30a
215a
32a
30
215
32
10
190
191
33
31
325
10d
33a
31a
196
190a
190b
78
10c
35
300
141
140
151
73
57
79
56
70a
72
67
71
412
65
70
59
68
69

SYSTEM FOR HANDLING FLEXIBLE SHEET ROLLS

BACKGROUND OF THE INVENTION

This invention relates generally to the handling of rollable sheets, and more particularly concerns equipment and method for rolling various types of sheets as for example vinyl plastic, carpeting, etc.

In the past, the handling of sheets to measure, cut-off to length, and re-roll them has been undesirably expensive in terms of involved labor cost. U.S. Pat. No. 3,931,940 describes apparatus which automatically unrolls, feeds, cuts and re-rolls carpet, thereby obviating the labor cost problems and also speeding up the handling of heavy carpet. However, there is continual need to simplify such apparatus and to improve its sheet handling capability. Also, there is need to improve, i.e. increase the reliability of the roll re-forming means, especially during starting of re-rolling, particularly for handling plastic sheets.

SUMMARY OF THE INVENTION

It is a major object of the invention to provide improved method and apparatus meeting the above described needs. Basically, and referring to the apparatus itself, it comprises:

(a) means to receive the advancing sheet and to roll same, (b) said means including support means over which the sheet travels, and auxiliary means including first and second swingable arm means and hold-down and dump rollers carried by the respective first and second arm means to be movable between primary positions in which the hold-down and dump rollers are relatively collapsed toward one another for initiating sheet coiling and a series of extended positions in which roll-up of the sheet is guided toward completion into a built-up roll, and the hold-down and dump rollers are increasingly spaced apart.

As will appear, the arms that carry the hold-down and dump rollers are swingable by actuator mechanism to displace the hold-down roll rearwardly and upwardly, and the dump roller forwardly and downwardly, whereby those rollers are gradually converted into auxiliary support rolls for the fore and aft sides of the built-up (re-rolled) sheet, prior to dumping thereof. Accordingly, a highly desirable degree of control of the sheet is provided for initiating proper coiling thereof, and also for supporting the sheet roll after its build-up.

Another object of the invention is to incorporate fore and aft main drive rolls on which the sheet roll builds up, such drive rolls located generally beneath the hold-down and dump rollers and having fixed position while the hold-down and dump rollers pivot away from one another. An eject roller may also be provided to be moved upwardly between the main drive rolls to urge the built-up sheet roll forwardly over the dump roll. All such rolls and rollers are typically rotated to aid formation and build-up of the sheet roll.

A further object of the invention is to provide shield means carried by the first arm to direct the advancing sheet initially against the underside of the hold-down roller before the sheet is turned downwardly by the dump roller toward a forward drive roll. That shield means is typically located between the hold-down roller and first drive roll in forwardly collapsed position of the hold-down roller; it has a first portion to facing the hold-down roller to form therewith a convergant zone directing the advancing sheet against the hold-down roller, and it has a second portion projecting downwardly forwardly of the first drive poll to scoop and direct the turned sheet back toward the underside of the overlying sheet extent, for initially coiling the sheet.

Other objects and advantages include the provision of dispensing means to supply cores onto the support rolls, to be wrapped by the sheet; the provision of adjustable pinch-rolls to tension the sheet advancing toward the re-roll apparatus; and the provision of drives for the various rolls and rollers, and allowing over-ride rotation of the dump roller for dumping a built-up sheet roll.

These and other objects and advantages of the invention, as well as the details of an illustrative embodiment, will be more fully understood from the following description and drawings, in which:

DRAWING DESCRIPTION

DETAILED DESCRIPTION

Figure 1:
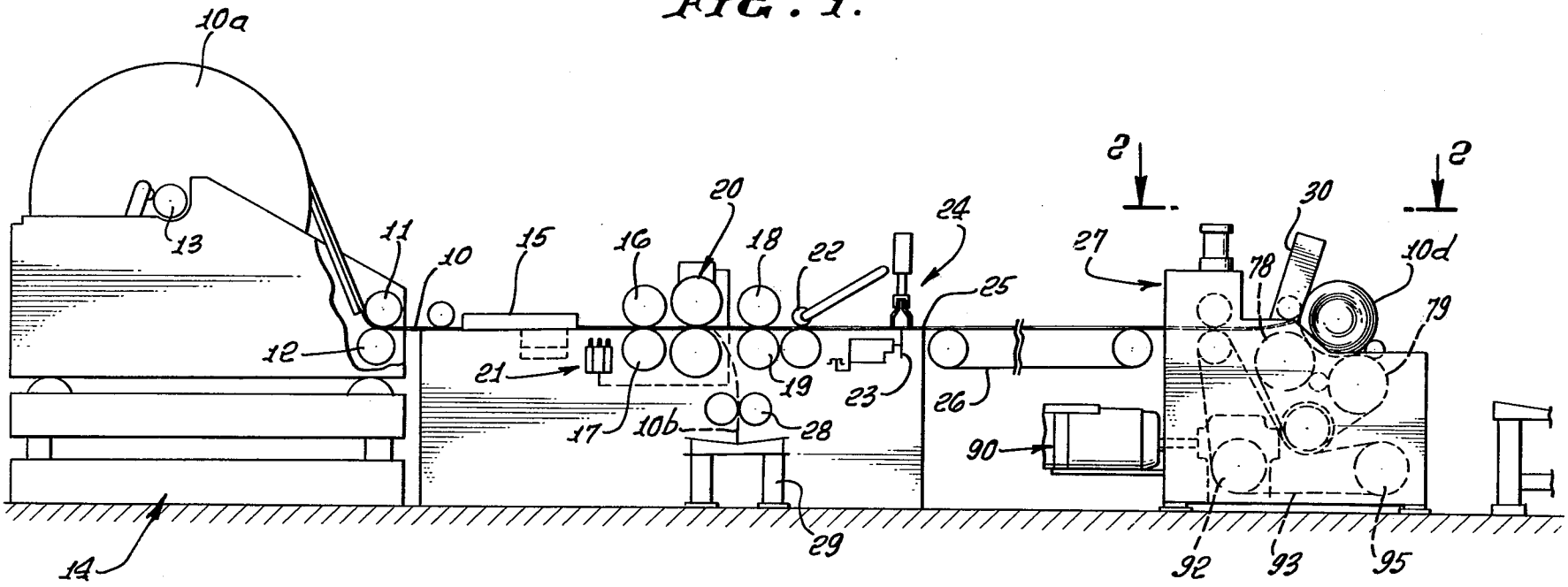
FIG. 1 is a side elevation of apparatus embodying the invention.

Referring first to FIG. 1, means is provided to advance a sheet 10 generally longitudinally forwardly. Such means may include pinch rolls 11 and 12 between which the sheet travels after leaving a supply roll **10*a*. The latter is carried on an axle or core 13 supported by unwind cradle 14. The forwardly advancing sheet travels adjacent a laterally spaced edge sensor 15** which position controls the cradle so as to accurately direct the sheet forwardly. See for example U.S. Pat. No. 3,931,940.

Thereafter, the advancing sheet passes between pinch roller pairs 16 and 17, and 18 and 19. Slitters may be provided at 20 to slit or trim the sheet lengthwise if desired, and as controlled by line scanners 21. A length measuring device 22 engages the sheet to measure the length thereof passing adjacent that device, and a cutter 23 is movable transversely on a support to cut the sheet to selected length beyond device 22. Clamp 24 holds the sheet downwardly on a table 25 during such cutting, the cutter extending through a slot in the table. Finally, a conveyor system 26 under the sheet advances it toward roll-up means indicated generally at 27. Scrap trim material may if desired be fed downwardly at **10*b* past a chopper 28 and to waste conveyor 29**.

Figure 3:
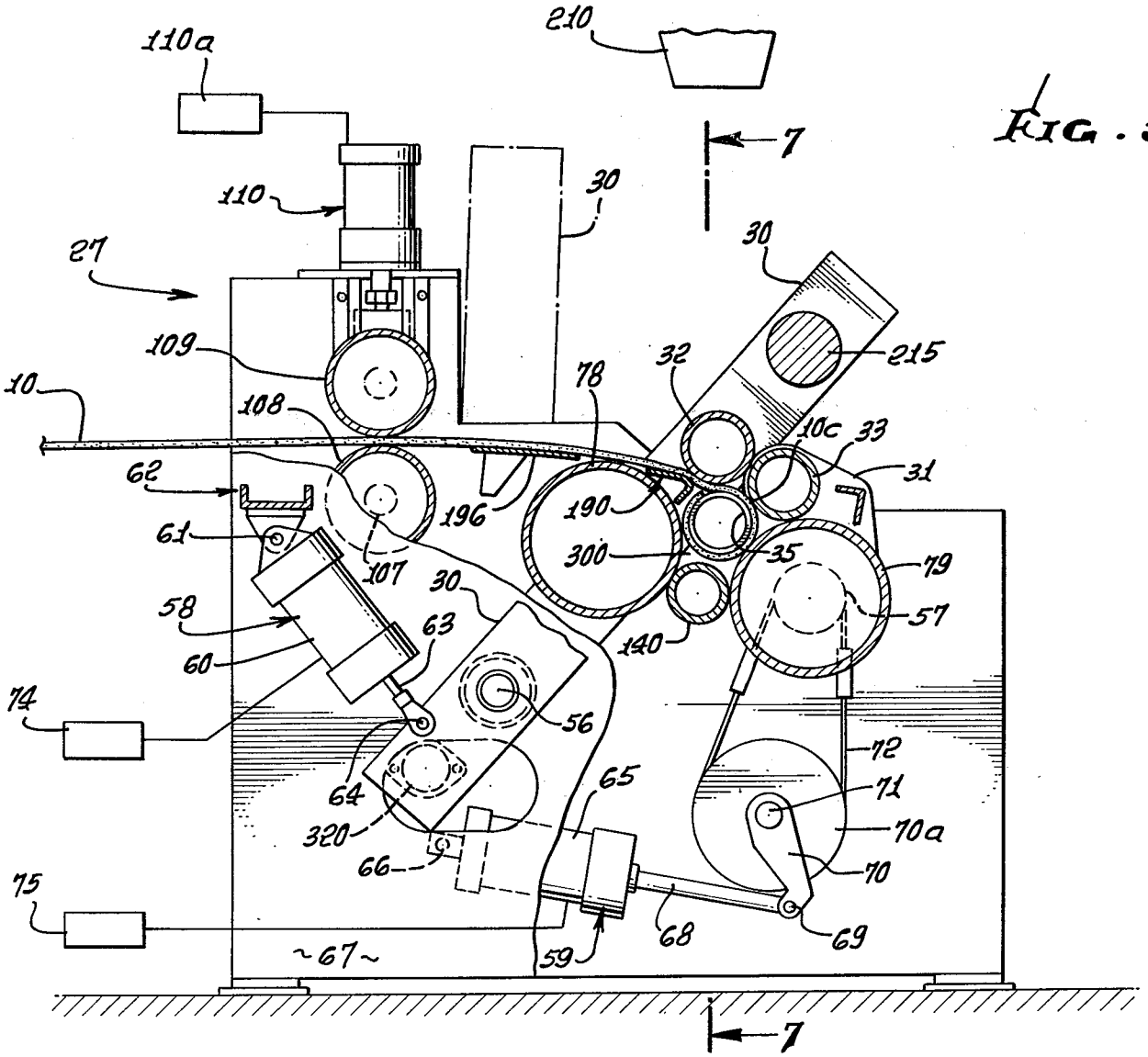
FIG. 3 is an enlarged elevation taken on lines 3—3 of FIG. 2.
Figure 8:
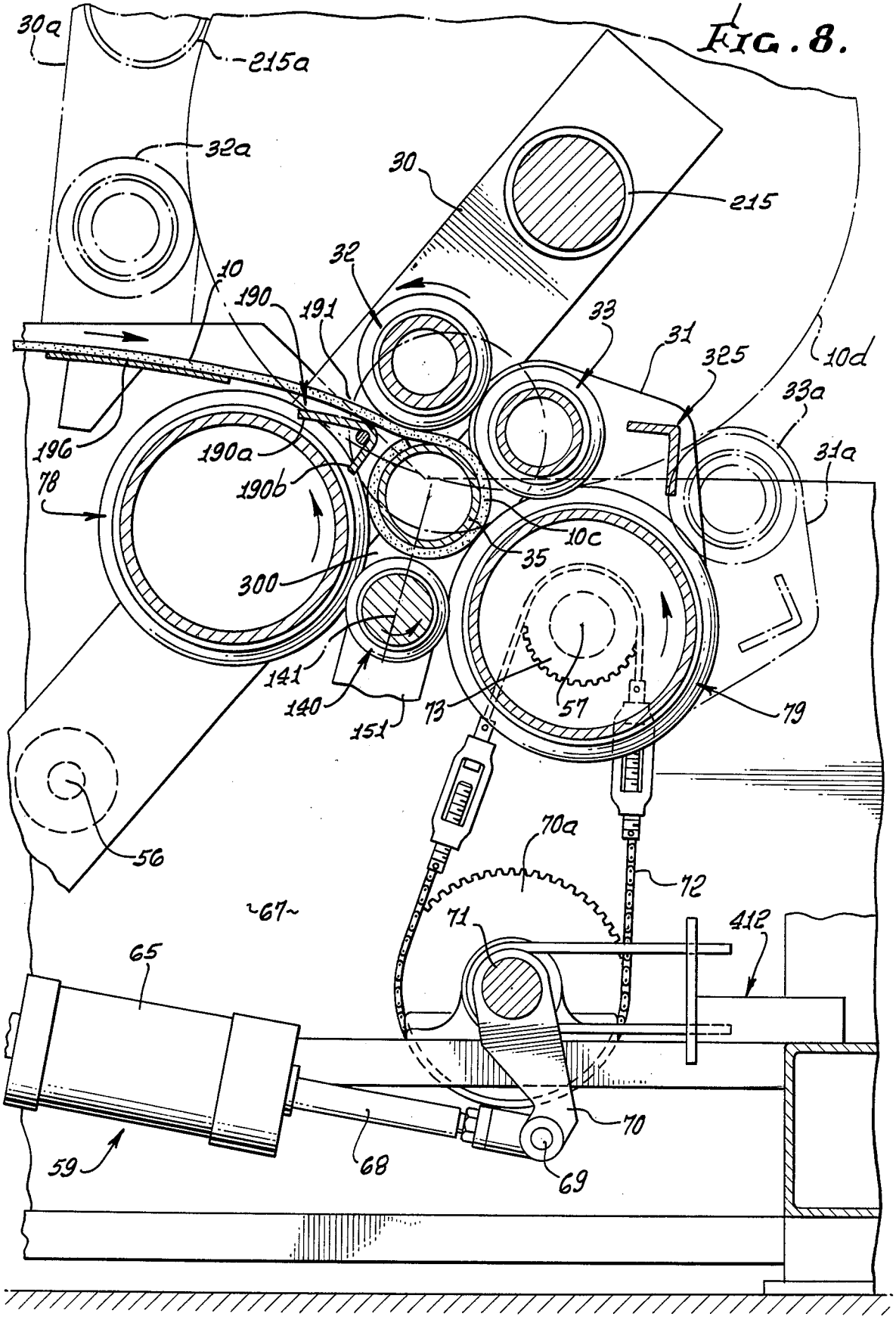
FIG. 8 is an enlarged vertical elevation on lines 8—8 of FIG. 6.

Extending the description to FIGS. 3 and 8, one form of means 27 is shown to include support means over which the advancing sheet travels, together with auxiliary means including first and second swingable arms 30 and 31 and hold-down and dump rollers 32 and 33 carried by the respective first and second arms. Generally speaking, the arms 30 and 31 are movable between primary position, as shown in FIGS. 3 and 8, in which the rollers 32 and 33 are relatively collapsed toward one another for initiating sheet coiling, and a series of extended or secondary positions in which roll-up of the sheet 10 is guided toward completion, as indicated by the enlarged sheet roll 10*d* in FIG. 8 and the broken line positions 30*a* and 31*a* of the arms, and the broken line positions 32*a* and 33*a* of the rollers 32 and 33. Note the inclusion of a cylindrical core 35 extending transversely and about which the initially coiling sheet 10*c* wraps. As the sheet rolls up or expands toward position 10*c*, rollers 32 and 33 progressively spread apart, arm 30 pivoting counterclockwise about axis 56 to move roller 32 upwardly and rearwardly, and arm 32 pivoting clockwise about axis 57 to move roller 33 first forwardly and upwardly and then forwardly and downwardly. Core 35 is in coil zone 300.

Means to swing the arms 30 and 31 is provided, and advantageously takes the form of separate actuators, one actuator 58 operatively connected to arm 30, and the second actuator 59 operatively connected to arm 31. Thus, for example, actuator 58 includes a cylinder 60 pivotally connected at 61 to frame structure 62, and rod 63 pivotally connected at 64 to arm 30. Actuator 59 includes a cylinder 65 pivotally connected at 66 to the frame 67, and a rod 68 pivotally connected at 69 to crank 70. As also seen in FIG. 8, the crank is connected to sprockets 70*a* that turn about axle 71 carried by the frame. Chains 72 entrain those sprockets as well as second sprockets 73 integral with arms 31. Accordingly, as the actuator rod 68 is displaced, the arm 31 rotates; however, as will be seen, the actuator provides primarily a roll balancing torque as the arms 31 swing to 31*a* position, and thereafter the actuator is used to positively swing arms 31 to eject or dump position. Actuator 58 functions primarily to move arms 30 in a roll eject mode; otherwise, the actuator does not substantially swing that arm, but allows it to swing under the influence of a counterweight 320 acting to counter clockwise torque to some extent, allowing the arm to merely exert reduced clockwise force on the roll 10*d*. Controls for the actuators are indicated at 74 and 75, in FIG. 3.

Figure 2:
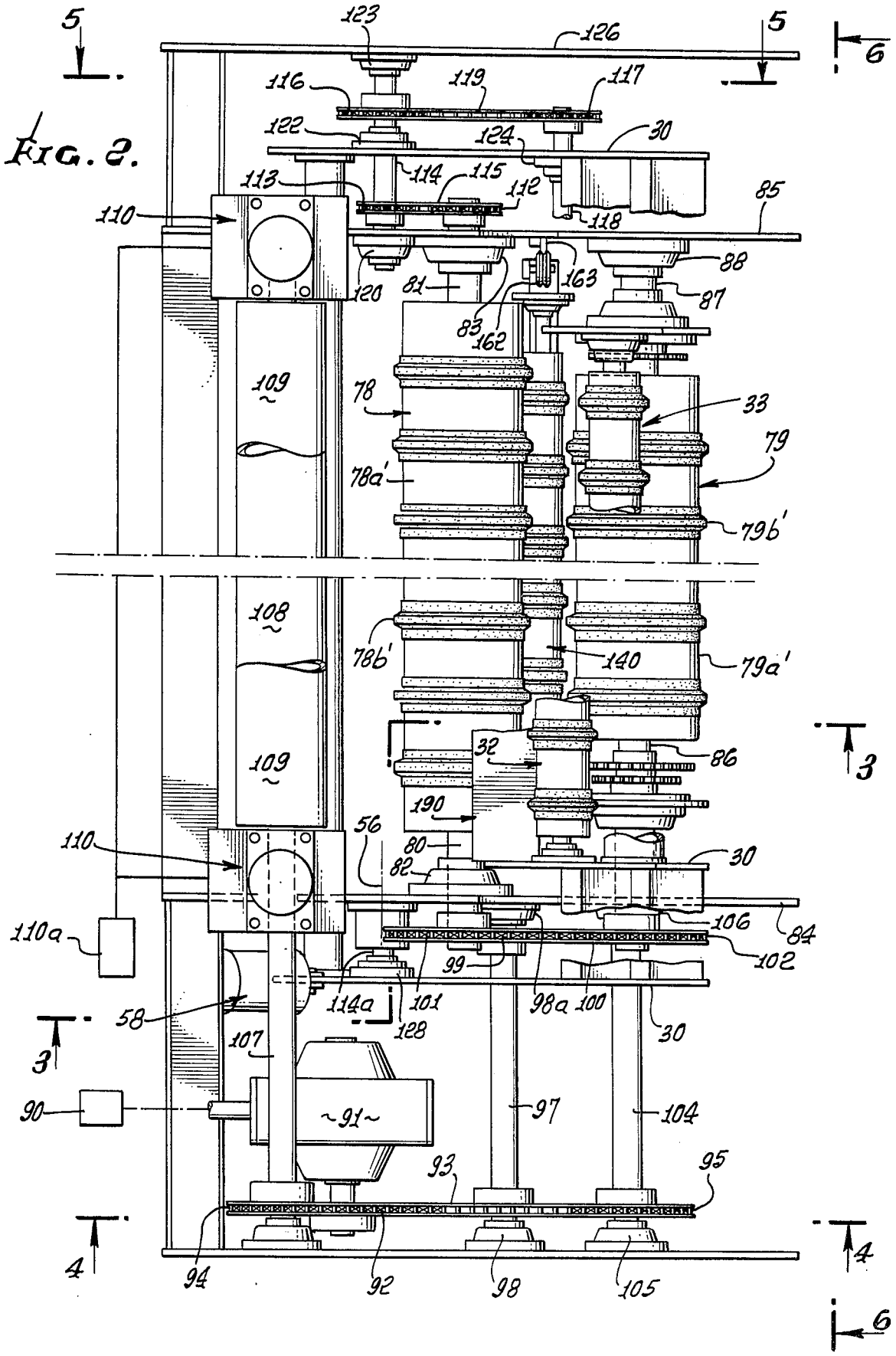
FIG. 2 is an enlarged plan view taken on lines 2—2 of FIG. 1.
Figure 4:
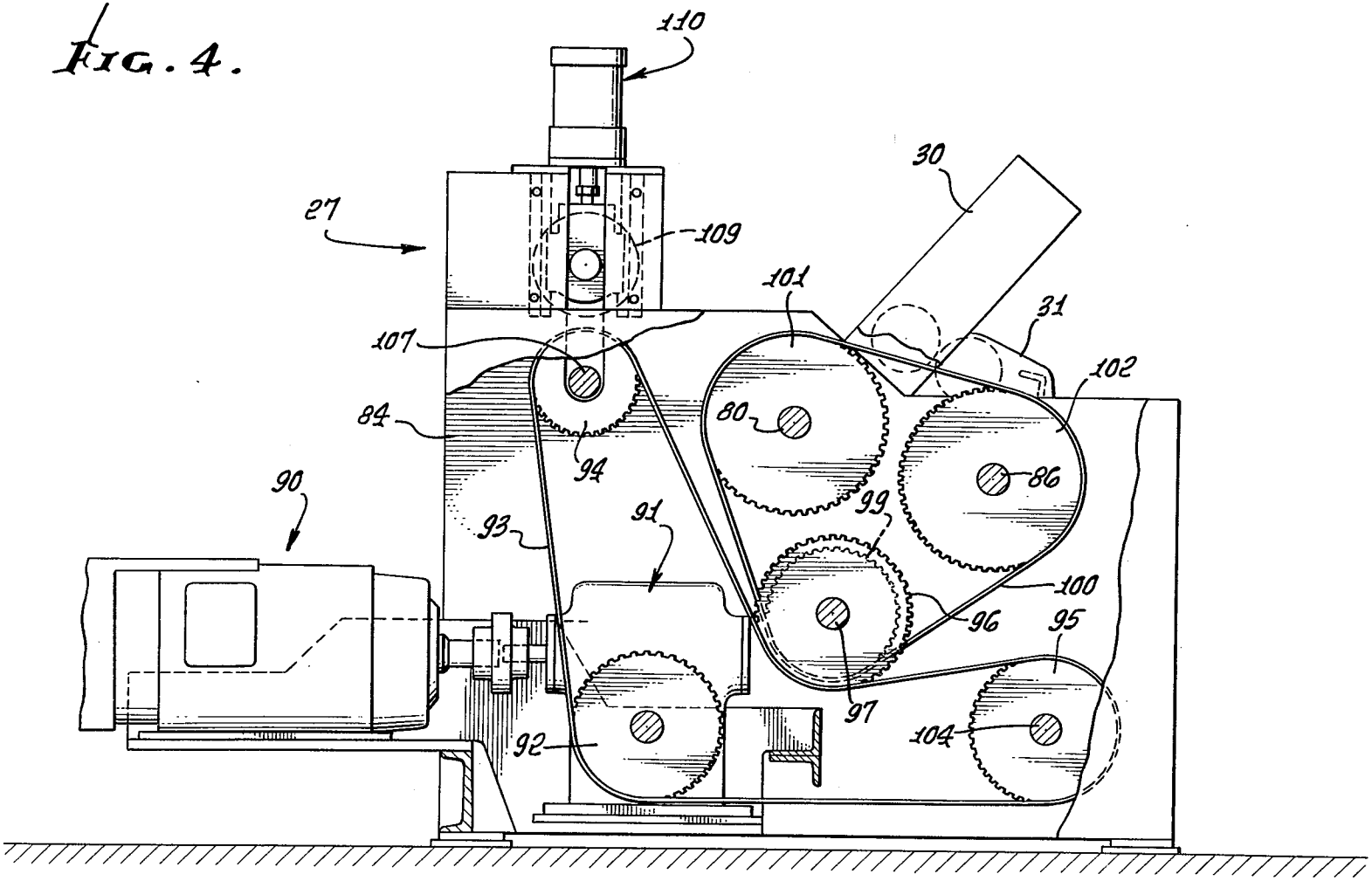
FIG. 4 is an enlarged side elevation taken on lines 4—4 of FIG. 2.
Figure 6:
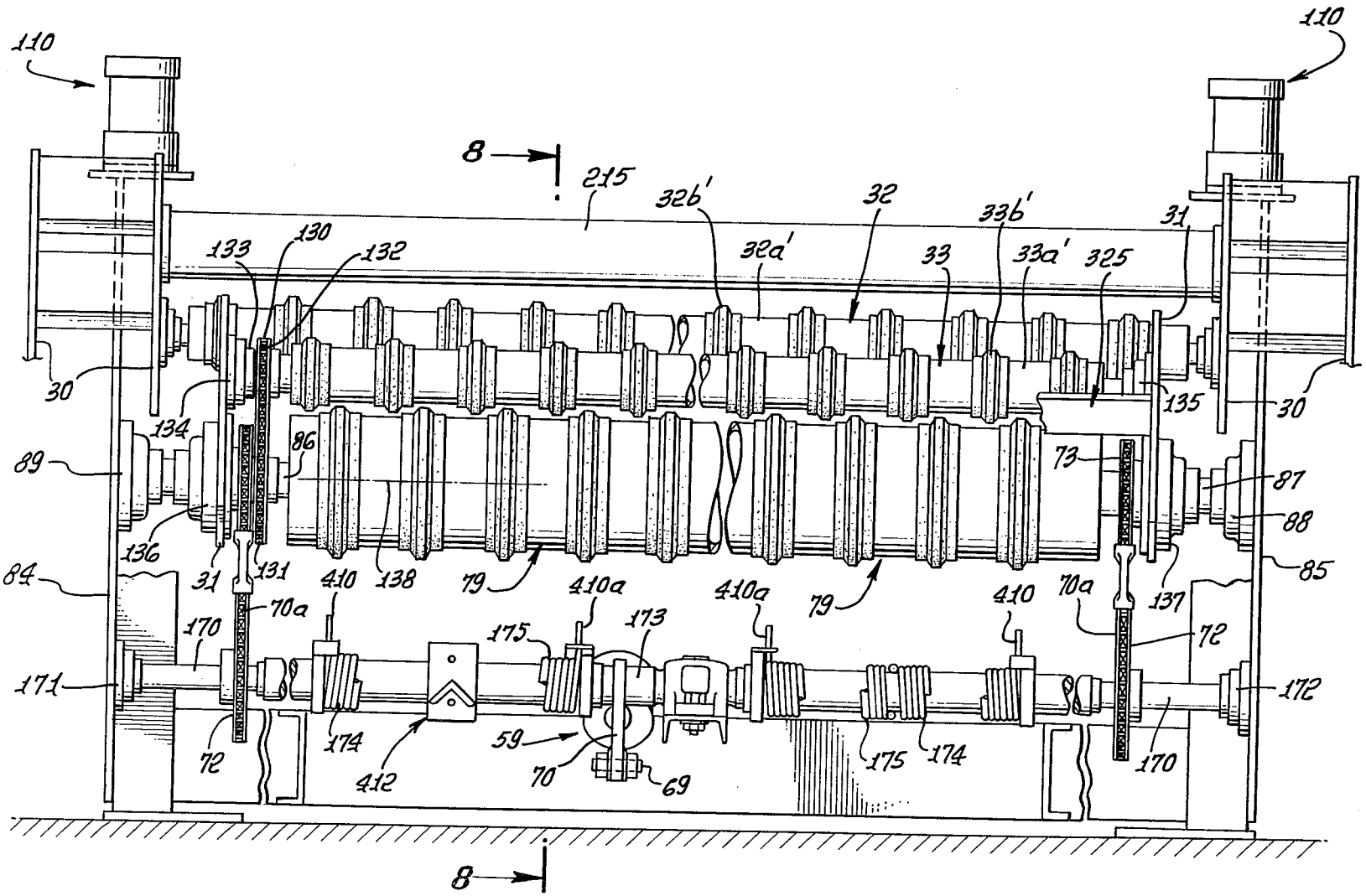
FIG. 6 is an enlarged elevation taken on lines 6—6 of FIG. 2.

The support means is shown to include multiple, transversely elongated drive rolls, such as drive rolls 78 and 79, to extend beneath and support the sheet coil 10*c* between rolls 78 and 79 and the collapsed rollers 32 and 33, during initial coiling of the sheet (as for example about the core 35). FIG. 2 shows the first drive roll 78 as having trunnions 80 and 81 journaled at 82 and 83 to the frame side plates 84 and 85. Similarly, FIGS. 2 and 6 show the second drive roll 79 as having trunnions 86 and 87 journaled at 88 and 89 to the side plates. The drive for the two support rollers originates at motor 90 and gear reduction unit 91. The latter drives a sprocket 92 entraining a chain 93 which also entrains sprockets 94, 95 and 96, as seen in FIGS. 2 and 4. Sprocket 96 is on a jack shaft 97 journaled to the frame at 98 and 98*a*. Shaft 97 drives a sprocket 99 which entrains an auxiliary chain 100. That chain in turn drives sprockets 101 and 102 connected with the shafts 80 and 86 of the drive rolls 78 and 79. Idler sprocket 95 is mounted on a shaft 104 journaled to the frame at 105 and 106.

Sprocket 94 drives a shaft 107 associated with lower pinch roller 108, better shown in FIG. 3. An upper idler pinch roller is shown at 109, and urged downwardly as by actuators 110, thereby to controllably pinch the sheet 10 as it advances toward the first drive roller 78. The sprocket gear ratios are such that the pinch roller surface velocity is slightly less than the surface velocities of the drive rollers, whereby the sheet material is tensioned as it travels between the pinch rollers and the drive rollers 78 and 79 associated with the roll up; however, this braking effect to the pinch rollers can be adjusted by actuators 110, for optimizing the roll up. See controls 110*a*.

Figure 5:
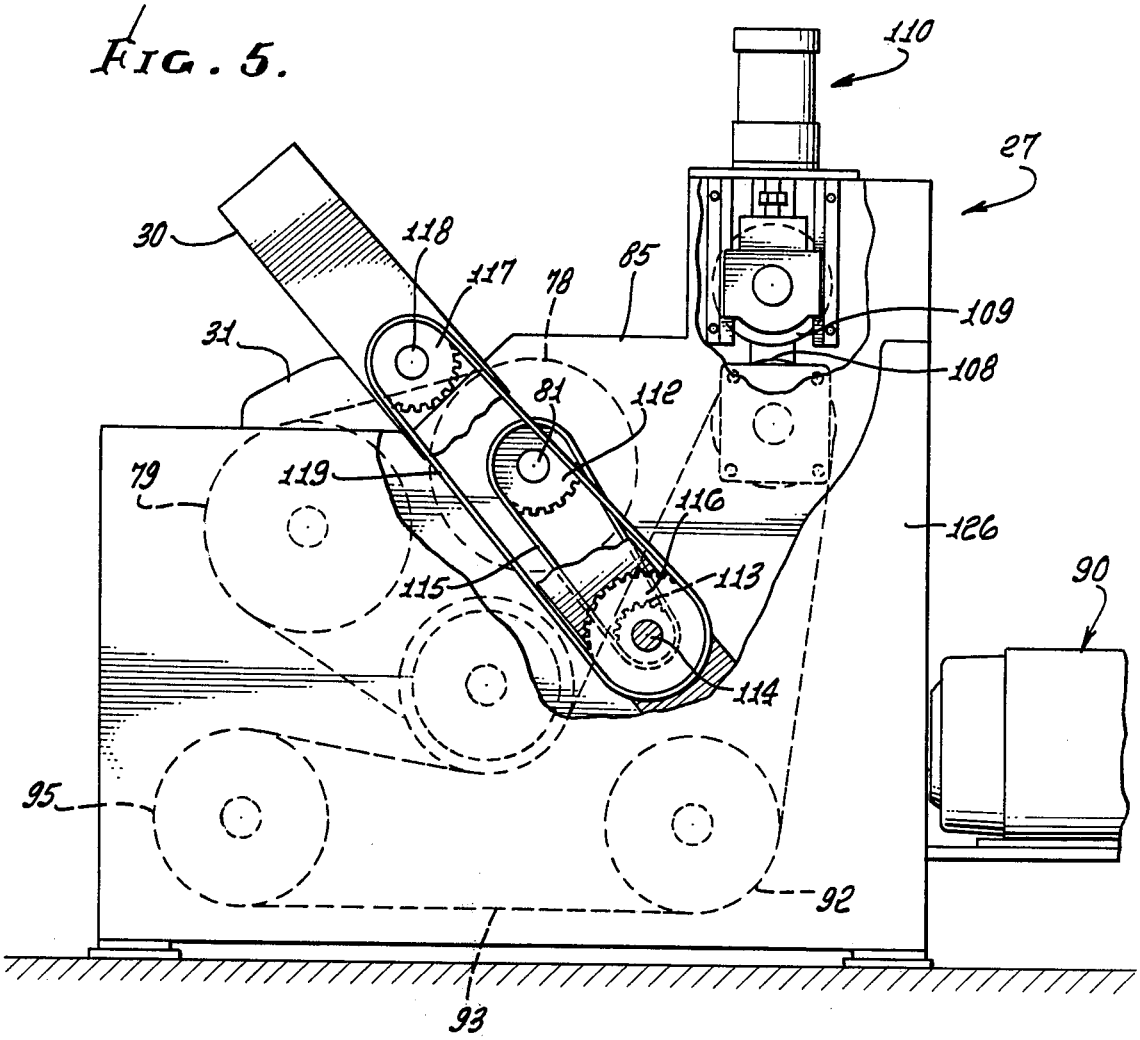
FIG. 5 is an enlarged side elevation taken on line 5—5 of FIG. 2.
Figure 10:
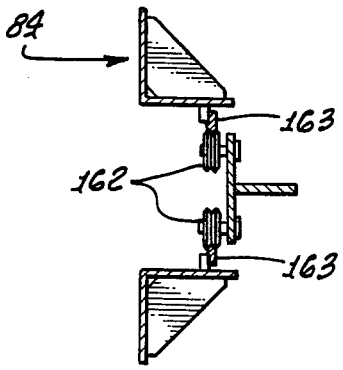
FIG. 10 is a section on lines 10—10 of FIG. 7.
Figure 11:
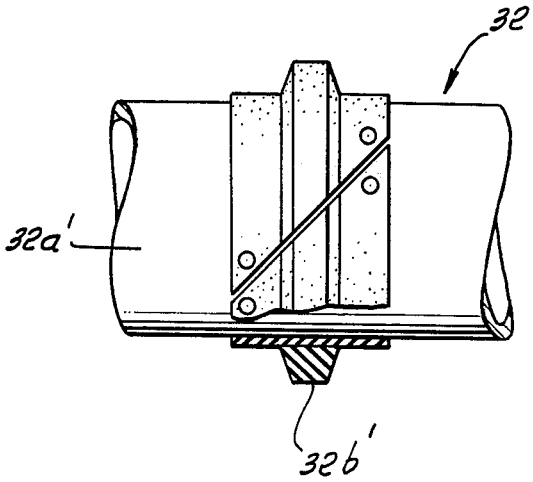
FIG. 11 is a view showing construction of roll 32.

FIGS. 2 and 5 show the means to drive the hold-down roller 32 as including sprocket 112 on shaft 81 of roll 78, sprocket 113 on jack shaft 114, a chain 115 entraining those sprockets; another sprocket 116 on shaft 114, a sprocket 117 on a shaft 118 integral with the hold-down roller, and a chain 119 entraining sprockets 116 and 117. Journals are shown at 120–124, and frame structure 125 and 126 supporting journals 120 and 123. Arm 30 supports journals 122 and 124. Two such arms are provided, as is clear in FIG. 2. Pivots for those arms are afforded by shafts 114 and 114*a* and journals 122 and 128.

Rotary drive to the dump roll 33 is shown in FIG. 6 as including a chain 130 entrained with a drive sprocket 131 on shaft 87 of drive roll 79, and a driven sprocket 132 on shaft 133 associated with the dump roll. Journals for the dump roll shafts 133 appear at 134 and 135, those journals being connected to the two swingable arms 31. Arms 31 are journaled at 136 and 137 to swing about the axis 138 of support roll 79. Note transverse structure 325 interconnecting arms 31, in FIG. 9.

Figure 7:
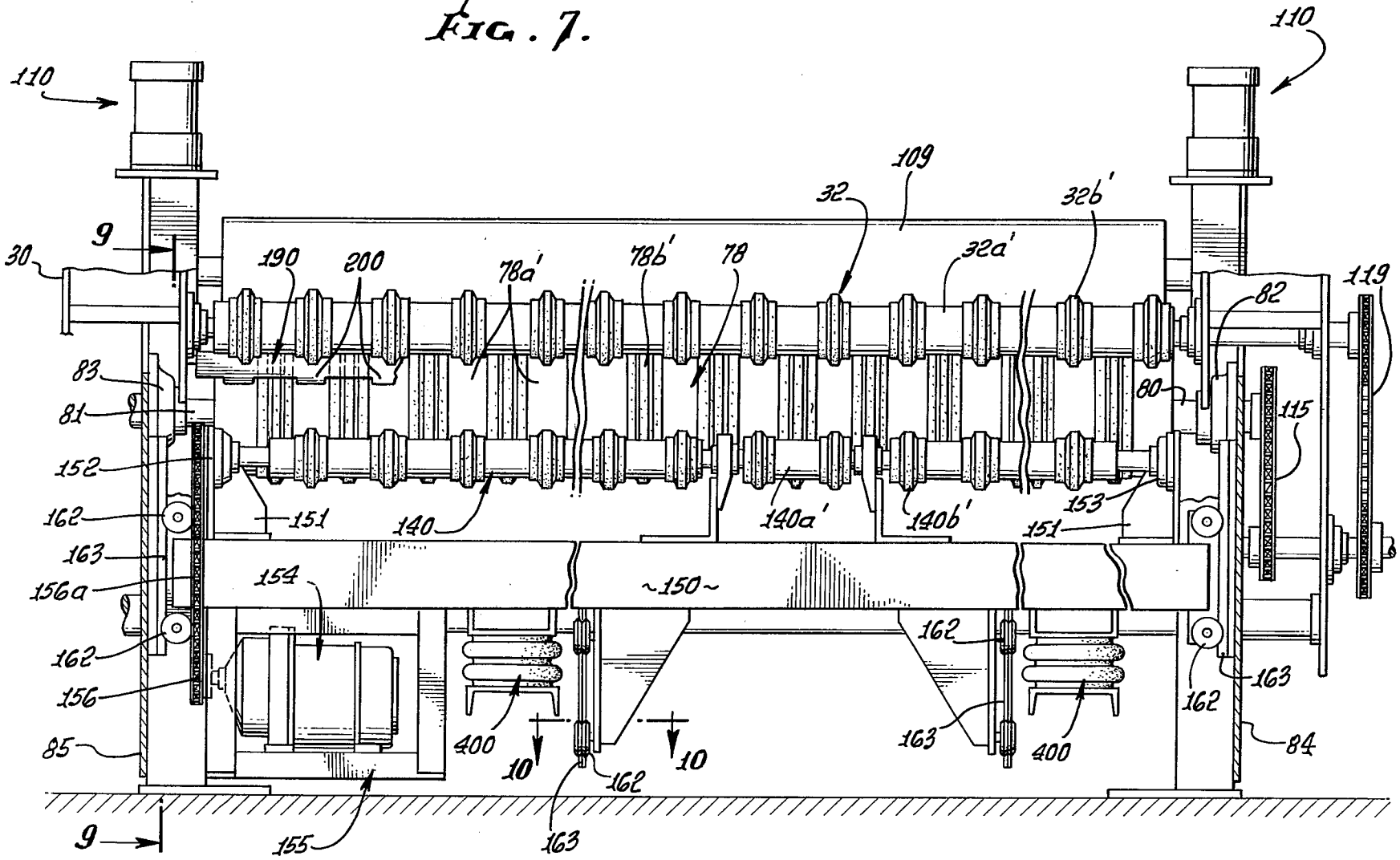
FIG. 7 is an enlarged vertical section on lines 7—7 of FIG. 3.
Figure 9:
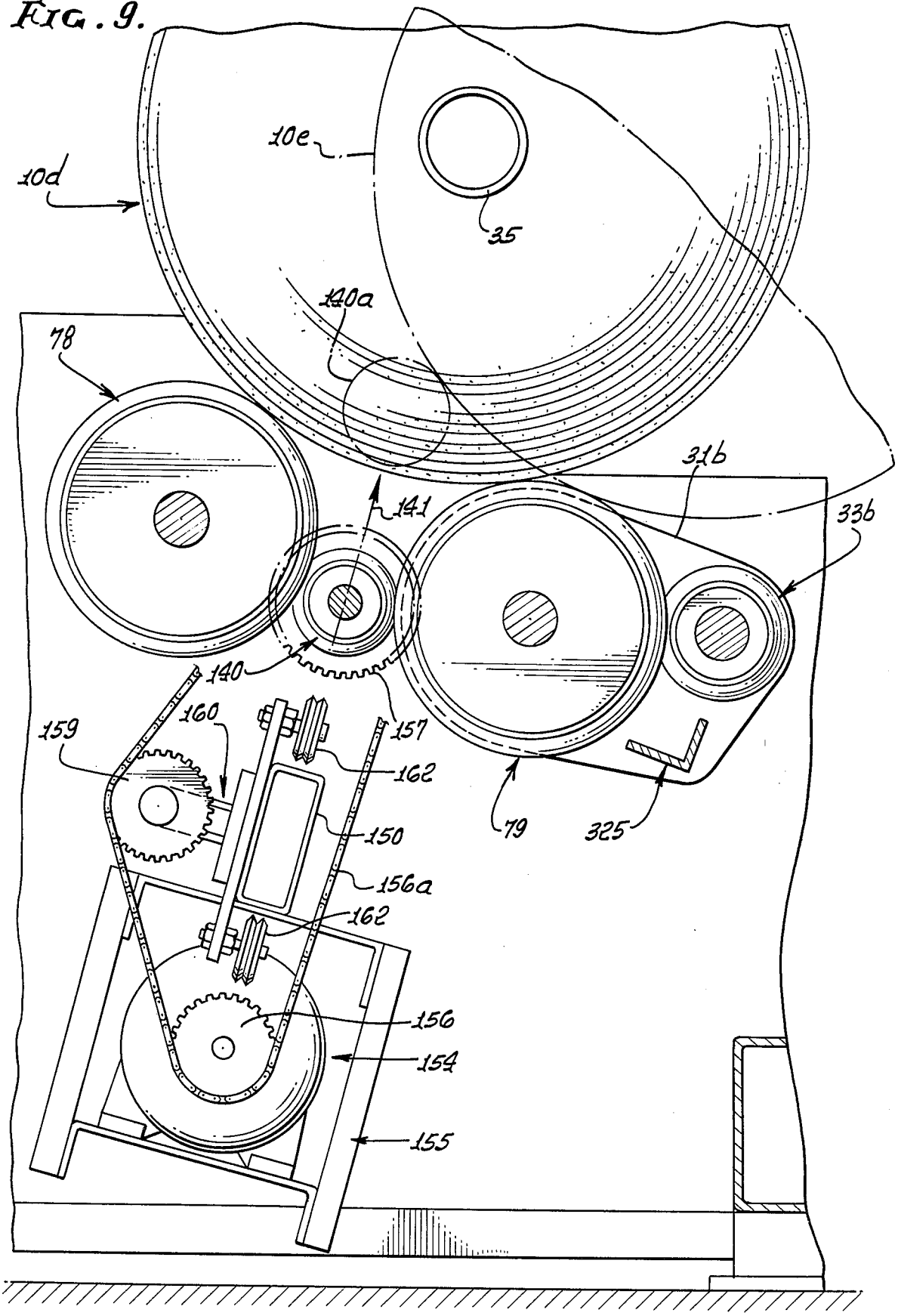
FIG. 9 is a view like FIG. 8, but showing the elements in roll dumping configuration.

Also provided is an eject roller 140 movable upwardly toward the built-up sheet roll and in a transverse plane 141 between the two drive rollers 78 and 79, to aid in ejecting the built-up sheet roll 10*d* off the mechanism, and over the support roll 79 shown in FIG. 8. FIG. 9 shows the built-up sheet roll in broken line position 10*e* being ejected over the dump roll in a lower clockwise position 33*b*. Means is connected with the eject roller to move it upwardly to engage the underside of the sheet roll 10*d* to push it upwardly and rightwardly as in FIG. 9. Note the elevated broken line position 140*a* of the eject roller. Such actuation means may for example include a transverse frame member 150 and uprights 151 thereon (see in FIG. 7) journaling the eject roller at 152 and 153. A driver to elevate and lower the frame member 150 includes eject, air-stroke actuators 400 engaging the underside of member 150. A motor and gear reducer unit 164 on a carrier 155 suspended by frame member 150 serves to rotate the eject roller. The motor drives a sprocket 156 entraining a chain 156*a* that is also entrained on a higher elevation sprocket 157 on the eject roller 140. An idler sprocket 159 is also carried at 160 by the member 150. Accordingly, as the motor operates, the eject roller is rotated. Guide means to guide elevation of the eject roller and frame 150 may include guide wheels 162 at the opposite ends of member 150, and tracks 163 on the frame members 84 and 85 and engaging peripheral grooves in the wheels.

FIG. 6 shows the provision of a coupling between the second arms 31 (for the dump roll 33) and the actuator mechanism 59 that rotates those arms, whereby swinging of those arms is accommodated in a sheet roll dumping direction, to allow the dump roller to swing to 33*b* position in FIG. 9, accommodating over-dumping of the completed sheet roll (rightwardly). Specifically, the coupling is located between the sprockets 70*a* and the crank 70. Sprockets 70*a* are fixed on small diameter shaft 170 journaled to the frame at 171 and 172. Crank 70 is connected to torque tube 173 to which small diameter shaft 170 is fixed. Torsion springs 174 and 175 are wrapped about that tube, and connected therewith at 410 and 410*a*. The opposite ends of the springs are connected to fixed frame structure via holders 412. The springs bias tube 173 so as to assist in balancing the sheet roll as it builds up. Actuator 59 positively rotates arms 31 from 31*a* positions in FIG. 8 to 31*b* positions in FIG. 9.

Finally, shield means is provided on the first arm or arms 30 to direct the advancing sheet (as for example a vinyl plastic sheet) initially against the underside of the hold-down roller, before the sheet is turned downwardly by the dump roller toward the drive roll 79. One such shield means is indicated at 190 as located between the hold-down roller and the first drive roll 78 in forwardly collapsed position of the arm 30 and hold-down roller 32. The shield is attached to arms 30 and extends therebetween. The shield means has a first portion 190*a* in the form of a thin plate extending generally horizontally and facing the hold-down roller (see FIG. 8) to form a convergent zone 191 between the portion 190*a* and roller 32 for guiding the sheet as described. A second portion 190*b* of the shield extends downwardly generally forwardly of the drive roll 78 to direct the turned sheet back toward the underside of the overlying sheet extent, for coiling of the sheet. This is important during initial coiling of the sheet forwardmost extent, but after the coil is established, and the arms 30 gradually swing counterclockwise, the shield means 190 is swung away from the zone it occupies in FIG. 8. Note also in FIG. 8 that hold-down roller 32 becomes a rear support roller for the built-up sheet roll, in its position 32*a*. The sheet is guided between the shield and hold-down roller as the arms 30 swing upwardly and rearwardly. A second guide or shield is indicated at 196 underlying the sheet 10 as it advances toward shield 190. Shield 196 is fixed, whereas shield 190 is movable, as described. Shield 196 keeps the sheet 10 out of contact with the top surface of roll 78.

Portion 190*b* of shield 190 may have a lowermost edge defined by laterally spaced tongues 200 that project closer to the axis of roll 78 (and toward the reduced diameter, laterally spaced surface sections 78*a*' of roll 78) than the surfaces 78*b* of the roll 78 to more effectively scoop the sheet 10 off the roll 78, that is, off of engagement with the larger diameter laterally spaced annular lands 78*b*' associated with that roll. Such tongues are diagrammatically indicated at 200 in FIG. 7. The other rolls and rollers 79, 32, 33 and 140 may have a construction like that of roll 78, with reduced diameter portions 79*a*', 32*a*', 33*a*' and 140*a*' laterally spaced between increased diameter lands 79*b*', 32*b*', 33*b*' and 140*b*', as shown. The latter roll portions may have hi-friction surfaces to frictionally engage the sheet with gripping action.

Turning back to FIG. 3, it shows a means (such as dispenser-hopper 210) to dispense cylindrical cores 35 downwardly onto the drive rolls 78 and 79 while the arm 30 is retracted, so that the core may be wrapped by the coiling sheet.

FIG. 8 also shows the provision of another roller 215 on arms 30 and spaced radially outwardly of hold-down roller 32, to engage the sheet roll (as at 215*a*) during eject of the built-up of the sheet roll 10*d*.

The sheet 10 may consist of plastic such as vinyl plastic material or flooring (having a vinyl surface on a backer sheet) for example, or carpet, or other material.

I claim:

1. In rollable sheet handling apparatus, and wherein a sheet is subject to advancement in a longitudinally forward direction, (a) means to receive the advancing sheet and to roll same, (b) said means including support means over which the sheet travels, and auxiliary means including first and second swingable arm means and hold-down and dump rollers carried by the respective first and second arm means to be movable between primary positions in which the hold-down and dump rollers are relatively collapsed toward one another for initiating sheet coiling, and a series of extended positions, in which roll-up of the sheet is guided toward completion into a built-up roll and said hold-down and dump rollers are increasingly spaced apart, (c) the dump roll having successively forward and lower positions as the sheet roll builds-up, the hold-down roll having successively rearward and elevated positions as the sheet roll builds-up, (d) said support means including multiple transversely elongated drive rolls to support the sheet as it is initially coiled between the drive rolls and the hold-down and dump rollers, said drive rolls and said hold-down and dump rollers remaining in supportive contact with the sheet roll as it builds-up toward its completed roll form, with the hold-down roller biasing the built-up sheet roll toward the dump roll.

2. The apparatus of claim 1 including means coupled to said first and second arm means to swing said arm means, and to urge the first arm means in a direction causing the hold-down roller to exert said bias.

3. The apparatus of claim 2 including a spring coupled to said second arm means to yieldably urge the second arm means in a direction carrying the dump roller toward collapsed position.

4. The apparatus of claim 2 wherein said means to swing said arms includes independently operated actuators connected to said arms to urge the first arm means toward collapsed position and against counter weight torque exerted on the first arm means, and to urge the second arm means toward extended positions, and against torque exerted by spring means on the second arm means.

5. The apparatus of claim 1 including another roller on said arm means and spaced from the hold-down roller to engage the sheet roll after predetermined build-up thereof.

6. The apparatus of claim 1 wherein the dump roller has successively forward and lower positions as the sheet roll builds-up.

7. The apparatus of claim 6 wherein the hold-down roller has successively rearward and elevated positions as the sheet roll builds-up.

8. The apparatus of claim 1 including an eject roller movable upwardly toward the built-up sheet roll and in a plane between two of said drive rolls, and means connected with said eject roller to move it upwardly to engage the underside of the built-up sheet roll for forwardly ejected the built-up sheet roll over the lowered dump roll.

9. The apparatus of claim 1 including shield means carried by the first arm to direct the advancing sheet initially against the underside of the hold-down roller before the sheet is turned downwardly by the dump roller toward a forward drive roll.

10. The apparatus of claim 9 wherein the shield means is located between the hold-down roller and the first drive roll in forwardly collapsed position of the hold-down roller.

11. The apparatus of claim 1 including means to dispense a cylindrical core downwardly onto the drive rollers prior to movement of said arms toward said collapsed position, the core to be wrapped by the sheet as it is coiled.

12. The apparatus of claim 1 including said sheet.

13. The apparatus of claim 12 wherein the sheet consists of plastic material.

14. The apparatus of claim 12 wherein the sheet consists of carpeting.

15. The apparatus of claim 1 including adjustable pinch roll means to engage the advancing sheet as it approaches said support means, for tensioning the sheet during sheet roll build-up.

16. The apparatus of claim 1 including means to rotate the hold-down and dump rollers as they are swung by said arm means and while they engage the rotating sheet roll.

17. The apparatus of claim 1 including pinch roller means for feeding the sheet toward the drive rolls and for restraining that feed during sheet roll-up to tension the sheet between the pinch roller means and the drive rolls.

18. In rollable sheet handling apparatus, and wherein a sheet is subject to advancement in a longitudinally forward direction, (a) means to receive the advancing sheet and to roll same about a core, (b) said means including support means over which the sheet travels, and auxiliary means including first and second swingable arm means and hold-down and dump rollers carried by the respective first and second arm means to be movable between primary positions in which the hold-down and dump rollers are relatively collapsed toward one another for initiating sheet coiling, and a series of extended positions, in which roll-up of the sheet is guided toward completion into a built-up roll and said hold-down and dump rollers are increasingly spaced apart while remaining in engagement with the sheet roll, (c) the dump roller having successively forward and lower positions as the sheet roll builds-up, the hold-down roller having successively rearward and elevated positions as the sheet roll builds-up, (d) said support means including multiple transversely elongated drive rolls to support the sheet as it is initially coiled between the drive rolls and the hold-down and dump rollers, (e) there being shield means carried by the first arm to direct the advancing sheet initially against the underside of the hold-down roller before the sheet is turned downwardly by the dump roller toward a forward drive roll, the shield means located between the hold-down roller and the first drive roll in forwardly collapsed position of the hold-down roller, (f) the shield means having a first portion facing the hold-down roller to initially direct the sheet against the hold-down roller as aforesaid, and a second portion projecting downwardly forwardly of the first drive roll to scoop and direct the turned sheet back toward the underside of the overlying sheet extent for initially and tightly coiling the sheet about a core, the sheet being guided between the shield and hold-down roller as the sheet advances onto the partially built-up sheet-roll, as the first arm swings relatively away from the second arm.

* * * * *